US005477462A

United States Patent [19]

McClung

[11] Patent Number: 5,477,462

[45] Date of Patent: Dec. 19, 1995

[54] METHOD AND SYSTEM FOR PREPARING AN ITEM FOR MAILING INCLUDING COST RECAPTURE FEATURE

[75] Inventor: William J. McClung, Arlington Heights, Ill.

[73] Assignee: Administrative Resource Options, Inc., Arlington Heights, Ill.

[21] Appl. No.: 969,792

[22] Filed: Oct. 30, 1992

[51] Int. Cl.[6] ..... G07B 17/00

[52] U.S. Cl. ..... 364/464.02; 177/25.15; 364/464.03

[58] Field of Search ..... 177/25.15; 364/464.02, 364/464.03, 466

[56] References Cited

U.S. PATENT DOCUMENTS

| | | | |
|---|---|---|---|
| 4,511,793 | 4/1985 | Racanelli | 364/464.03 |
| 4,908,770 | 3/1990 | Breault et al. | 364/464.02 |
| 4,941,091 | 7/1990 | Breault et al. | 364/406 |
| 4,959,795 | 9/1990 | Christensen et al. | 364/478 X |
| 4,962,459 | 10/1990 | Mallozzi et al. | 364/464.02 |
| 5,119,306 | 6/1992 | Metelits et al. | 364/464.02 |
| 5,161,109 | 11/1992 | Keating et al. | 364/464.02 |
| 5,283,752 | 2/1994 | Gombault et al. | 364/464.02 X |

*Primary Examiner*—Edward R. Cosimano

*Attorney, Agent, or Firm*—Hill, Steadman & Simpson

[57] ABSTRACT

A system for preparing an item for mailing includes an information storage device for storing information as a plurality of information elements. A printing device is operatively connected to the information storage device for printing selected ones of the information elements, including address information relating to a preselected addressee and billing information relating to a particular account. The system further includes a postage metering device which receives the item after the printing device prints the selected information elements and applies an indicium of a postage amount on the item to be mailed according to at least one parameter associated with that item. The postage metering device includes a data input device for receiving data and a recording device for recording reporting information including the billing information and the postage amount for the item prepared for mailing. The postage metering device receives, via the data input device, the billing information for recording in the recording device. The postage metering device is responsive to a user inquiry to later display the reporting information on request.

5 Claims, 2 Drawing Sheets

METHOD AND SYSTEM FOR PREPARING AN ITEM FOR MAILING INCLUDING COST RECAPTURE FEATURE

BACKGROUND OF THE INVENTION

In today's environment of increasing postal rates, increasing paper costs, and other associated increasing costs of mailing, expenditures for mailing items have risen to a level which makes it desirable to be able to charge-back, or pass through, those mailing expenditures to those clients or customers to whom such costs can be identified. Such an ability to charge-back costs is preferable to charging all mailing costs off as an overhead expense, as has generally occurred in the past.

A number of attempts have been made to systematically identify mailing costs with particular accounts: for example, U.S. Pat. No. 4,962,459 for "System for Accounting for Postage Expended by a Postage Meter Having Data Security During Printing" to Mallozzi et al. discloses a postal system which responds to entry of postal information via an input interface and receives postal-amounts information via an interface to update an account record. The Mallozzi et al. system comprises a data entry apparatus, such as a keyboard, an interface, a printer, a memory (including a non-volatile memory), and a central processing unit.

Other attempts at controlling postal costs and attributing those costs to particular accounts via an account code system are represented by U.S. Pat. No. 4,908,770 for "Mail Management System Account Validation and Fallback Operation" to Breault et al., and U.S. Pat. No. 4,941,091 for "Mail Management System Transaction Data Customizing and Screening" to Breault et al. Both of these patents employ a computer-based system capable of working with a plurality of work stations connected and communicating with postage machines. Both systems are suited to large organizations or operations but are too costly for smaller-size operations.

Of course, the costs of mail have increased for small operations as well as large operations, and it is perhaps even more important to recapture mailing costs in a small operation.

SUMMARY OF THE INVENTION

A system for preparing an item for mailing comprises an information storage device for storing information as a plurality of information elements; a printing device operatively connected with the information storage device for printing selected of the information elements, which selected information elements include address information relating to a preselected addressee and billing information relating to a particular account. The system further comprises a postage metering device which receives the item after the printing device has printed the selected information elements and applies an indicium of a postage amount to the item to be mailed according to at least one parameter associated with that item.

The postage metering device includes a data input device for receiving data and a recording device for recording reporting information, which reporting information includes the billing information and the postage amount for the item being prepared for mailing. The postage metering device receives, via the data input device, the billing information for recording in the recording device, and the postage metering device is responsive to a user inquiry to later display that reporting information on request.

It is, therefore, an advantage of the present invention to provide a system for preparing an item for mailing which is inexpensive to implement and provides recapture of information relating postage amounts with particular accounts to be charged for that postage amount.

Further advantages and features of the present invention will be apparent from the following specification and claims when considered in connection with the accompanying drawings illustrating the preferred embodiment of the invention.

DETAILED DESCRIPTION OF THE INVENTION

Figure 1:
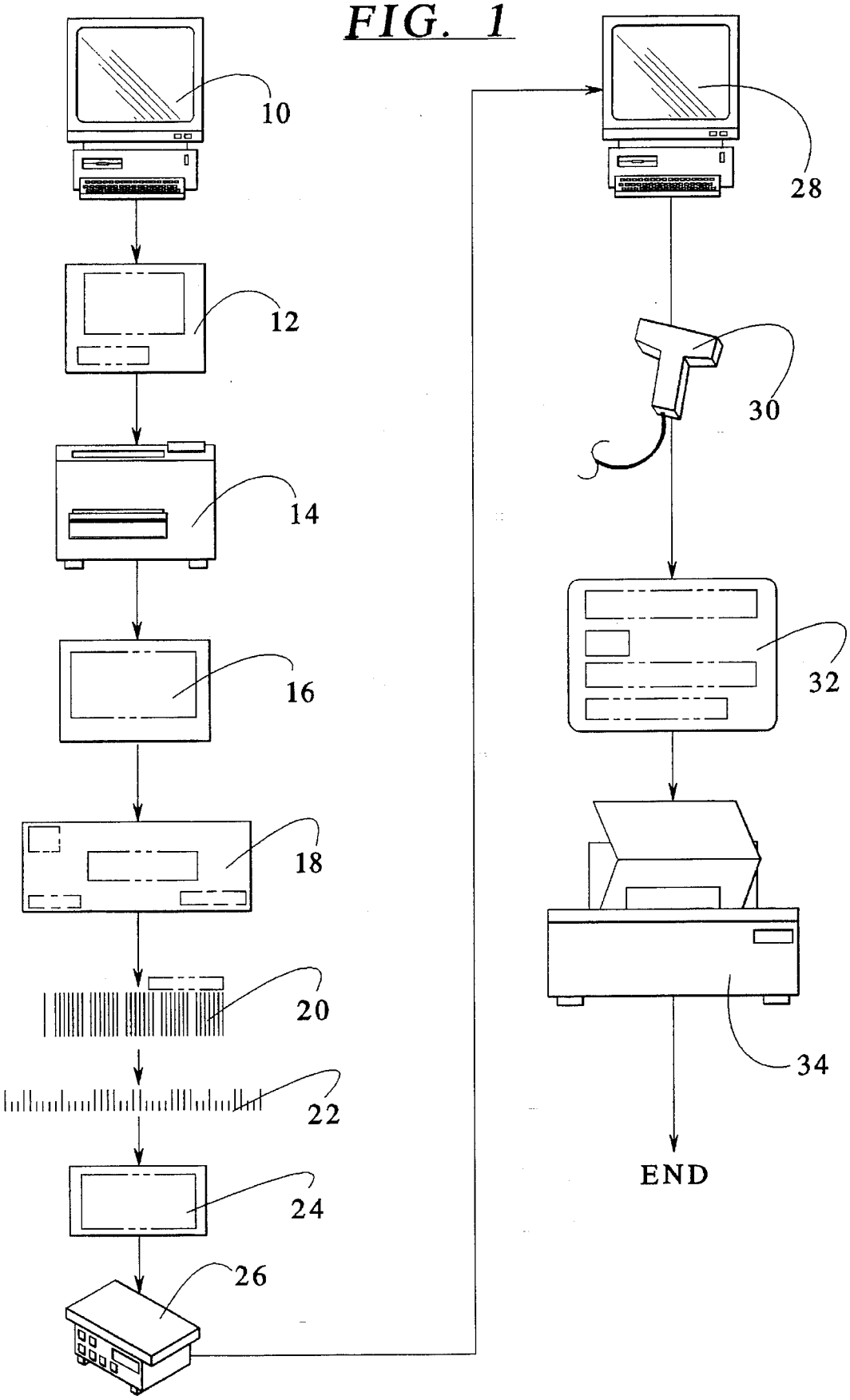
FIG. 1 is a schematic representation of the method of the present invention.

FIG. 1 is a schematic representation of the preferred embodiment of the method of the present invention. In FIG. 1, the method of the present invention is represented by a series of steps:

According to step 10, a user accesses a data base stored in a storage device by utilizing predetermined software to identify within the stored data base a client name or client code to select and retrieve address information for a particular client.

According to step 12, the selected address information is displayed by a display device associated with the storage device, along with the appropriate client code associated with the address information. Preferably, the display is in a format which allows a user to modify or update the information on-line if desired.

By step 14, the user loads an envelope (or other item to be mailed, such as a mailing label) into a printer, such as a laser printer.

By step 16, the user selects an appropriate key (or other actuating device) to cause the printer to print the desired information on the item to be mailed.

By step 18, the printer responds to the input supplied by the user in step 16 and prints the address information.

By step 20 the client code and, by step 22 the zip+4 code associated with the selected address are imprinted on the item to be mailed. In the preferred embodiment, the client code information (step 20) is printed in a code 39 format which is a bar code format meeting the Frieden Alcatel postage meter device specifications and machine-readable by such postage meter devices. Further in the preferred embodiment, the zip+4 code (step 22) is printed in the Postnet format which meets the United States Postal Service specifications for such zip+4 printing.

By step 24 an office services department representative (or other means of conveyance) retrieves the item from the user at the printer.

By step 26, the representative places the item onto the postage meter scale. According to the preferred embodiment of the present invention, the postal meter is a Frieden Alcatel-type postage meter, which has a scale as well as an associated computer and display. Certain postage meter devices have even more capabilities of parameter-measuring to measure bulk or other parameters of the item. Such additionally-capable postage meter devices are intended as within the scope of the present invention.

According to step 28, the postage meter computer is programmed to request the user to input the type of mailing service to be used; the user is required to select a response from a menu before the postage meter device imprints an indicium of postage amount on the item to be mailed.

According to step 30, the postage meter computer is also programmed to ask for a billing code identifying a particular account to which the postage amount associated with the item to be mailed is to be charged. The office services representative effects scanning of the client code imprint provided according to step 20, preferably with a bar code scanner providing the billing code in machine readable form to the postage meter computer.

According to step 32, the mail service selected, cost of mailing the item, the date, and the associated client code are electrically stored in the postage meter computer.

According to step 34, the thus-stored information (according to step 32) may at any time be accessed by an office services representative or other authorized person by appropriately inquiring of the stored data in the postage meter computer, preferably in a predetermined report format.

Figure 2:
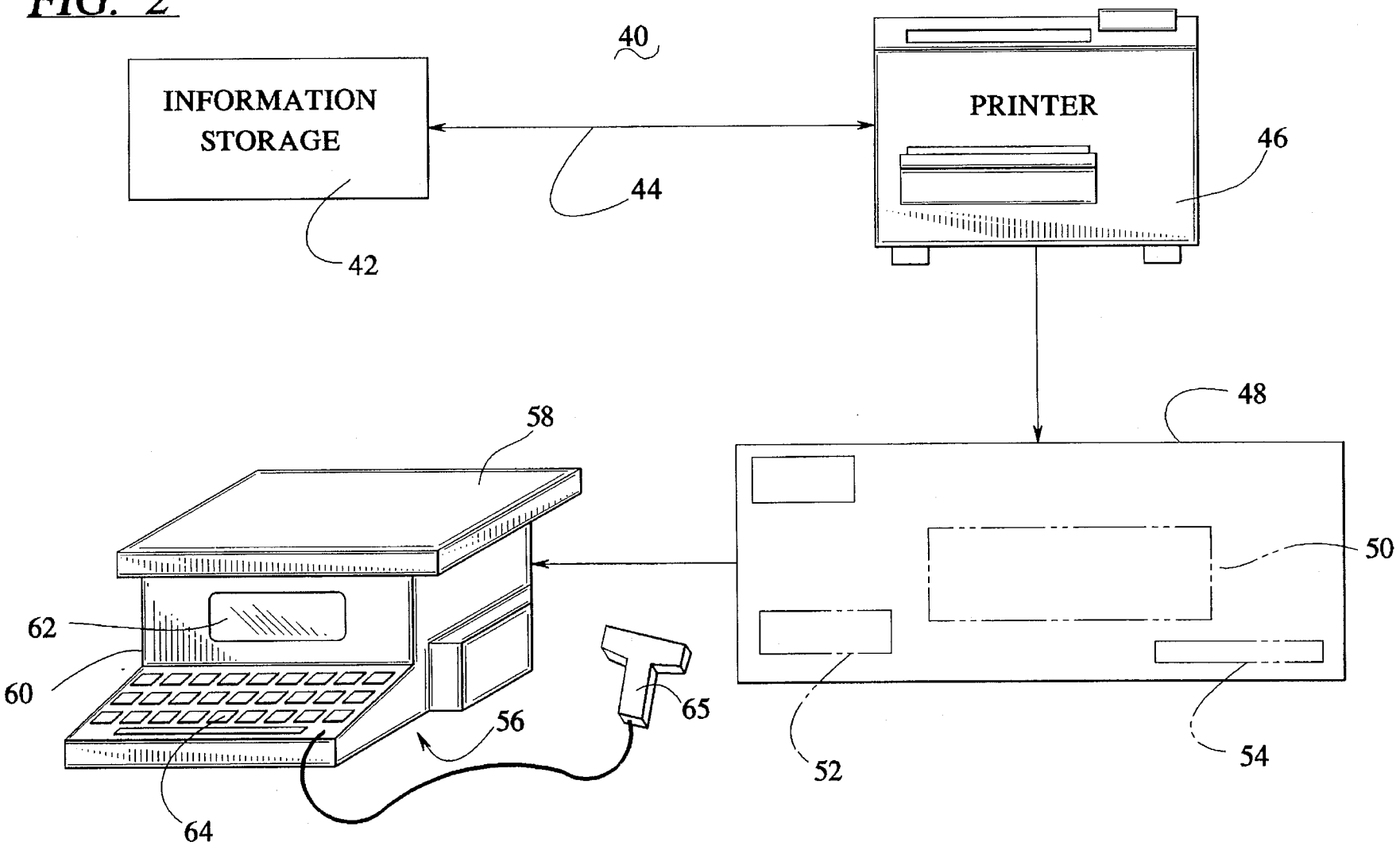
FIG. 2 is a schematic representation of the apparatus of the present invention.

FIG. 2 is a schematic representation of the apparatus of the present invention. In FIG. 2, a mailing system 40 is illustrated comprising an information storage device 42 which is electrically communicative, as indicated at 44, with a printer 46. Preferably, printer 46 is an intelligent printer capable of receiving inputs from a user to inquire as to data stored in information storage device 42 and to retrieve such information from information storage device 42 for use in printing operations.

Accordingly, in response to a user input, printer 46 employs such retrieved information in imprinting an item 48 for mailing. Of course, the printing can be effected on a mailing label which can then, subsequently, be affixed to item and still remain within the scope of the present invention. Preferably, item 48 is imprinted with address information, as at site 50; customer account information, as at site 52, and zip+4 information, as at site 54.

Item 48 is physically conveyed to a postage meter device 56 (e.g., by carrying, by conveyor, or the like). Postage meter device 56 preferably has a scale 58 for weighing items 48 and an associated postage meter computer 60. Postage meter computer 60 has a display 62 and an input apparatus 64, such as an input keyboard.

In its most-preferred embodiment, printer 46 prints account information at site 52 in a machine readable format recognizable by an input apparatus 65, such as a bar code scanner device. Thus, account information can be scanned by input apparatus 65 for electronic input to postage meter computer 60. Further according to the most-preferred embodiment, printer 46 imprints zip+4 information at site 54 in a machine-readable format acceptable to the United States Postal Service, such as a Postnet format.

Postage meter computer 60 stores address information for later access by a user, preferably in a predetermined report format.

It is to be understood that, while the detailed drawings and specific examples given describe a preferred embodiment of the invention, they are for the purpose of illustration only, that the apparatus of the invention is not limited to the precise details and conditions disclosed and that various changes may be made therein without departing from the spirit of the invention which is defined by the following claims.

I claim:

1. A system for preparing an envelope holding an item for mailing wherein an amount of postage is necessary for mailing the envelope holding the item and further wherein the amount is billable to an account of an external client, the system comprising:

an information storage means storing information, said information stored as a plurality of information elements;

a printing means operatively connected with said information storage means capable of printing selected information elements of said plurality of information elements on said envelope, said selected information elements including address information relating to a preselected addressee and including billing information which includes the account of the external client; and a postage metering means applying an indicium of the postage amount to said envelope according to at least one parameter associated with said item, said postage metering means receiving said envelope after said printing means has printed said selected information elements, said postage metering means including a data input means receiving data and a recording means recording reporting information, said reporting information including said billing information and said postage amount for said envelope, said postage metering means receiving via said data input means, said billing information for recording in said recording means, said postage metering means responsive to a user inquiry to display said reporting information.

2. The system of claim 1 wherein said postage metering means requires said receiving of said billing information before applying said indicium of postage amount.

3. The system of claim 1 wherein said indication of said billing information is recorded on said envelope in a bar code format and said data input means comprises a bar code reader, said bar code reader configured to scan said billing information on said envelope.

4. The system of claim 2 wherein said indication of said billing information is recorded on said envelope in a bar code format and said data input means comprises a bar code reader, said bar code reader configured to scan said billing information on said envelope.

5. A method for preparing an envelope holding an item for mailing wherein an amount of postage is necessary for mailing the envelope holding the item and further wherein the amount is billable to an account of an external client, the method comprising the steps of:

imprinting predetermined information on said envelope, said predetermined information including address information relating to a preselected addressee and including billing information which includes the account of the external client;

delivering said envelope to a postage metering means for applying an indicium of the postage amount to said envelope according to at least one parameter associated with said item, said postage metering means including a data input means for receiving data and a recording means for recording reporting information, said reporting information including said billing information and said postage amount for said envelope; and providing said billing information to said postage metering means via said data input means for recording in said recording means substantially concurrently with applying said indicium of postage amount.

* * * * *